US008918913B2

(12) United States Patent
Power

(10) Patent No.: US 8,918,913 B2
(45) Date of Patent: Dec. 30, 2014

(54) ANTI-JAM FINGER PROTECTIVE DEVICE

(76) Inventor: Tim Power, Stittsvile (CA)

( * ) Notice: Subject to any disclaimer, the term of this patent is extended or adjusted under 35 U.S.C. 154(b) by 1158 days.

(21) Appl. No.: 12/844,930

(22) Filed: Jul. 28, 2010

(65) Prior Publication Data

US 2011/0035856 A1 Feb. 17, 2011

Related U.S. Application Data

(60) Provisional application No. 61/232,869, filed on Aug. 11, 2009.

(51) Int. Cl.
*A41D 19/00* (2006.01)
*A41D 13/08* (2006.01)

(52) U.S. Cl.
CPC ..... *A41D 13/087* (2013.01)
USPC ..... 2/16; 2/161.1

(58) Field of Classification Search
CPC .. A41D 13/082; A41D 13/084; A41D 13/087
USPC ..... 2/16, 20, 19, 21, 161.1, 161.6, 163; 602/21, 22
See application file for complete search history.

(56) References Cited

U.S. PATENT DOCUMENTS

| | | | | | |
|---|---|---|---|---|---|
| 321,529 | A * | 7/1885 | Rate | 30/123.5 |
| 1,951,190 | A * | 3/1934 | Gambee | 2/21 |
| 3,038,723 | A * | 6/1962 | Bergendorf | 473/61 |
| 4,051,553 | A * | 10/1977 | Howard | 2/20 |
| 4,766,612 | A * | 8/1988 | Patton, Sr. | 2/16 |
| 5,168,578 | A | 12/1992 | Stanley | |
| 5,231,700 | A * | 8/1993 | Cutshall | 2/161.7 |
| 5,528,772 | A | 6/1996 | Cheek | |
| 5,600,849 | A * | 2/1997 | Hu | 2/16 |
| 5,640,712 | A | 6/1997 | Hansen et al. | |
| 5,692,242 | A * | 12/1997 | Tekerman et al. | 2/161.1 |
| 5,881,385 | A * | 3/1999 | Hochmuth | 2/161.1 |
| 5,898,938 | A | 5/1999 | Baylor et al. | |
| 6,427,246 | B1 | 8/2002 | Doi et al. | |
| 7,100,212 | B2 * | 9/2006 | Jaeger | 2/161.1 |
| 7,406,720 | B2 * | 8/2008 | Hoelscher | 2/161.1 |
| 7,574,748 | B2 * | 8/2009 | Fisher et al. | 2/16 |
| 7,682,261 | B1 * | 3/2010 | Addington et al. | 473/61 |
| 8,028,347 | B2 * | 10/2011 | Chang | 2/161.1 |
| 2004/0025226 | A1 * | 2/2004 | Jaeger | 2/161.6 |
| 2004/0148675 | A1 * | 8/2004 | Powell | 2/16 |
| 2007/0083968 | A1 * | 4/2007 | Stokes | 2/16 |
| 2007/0226866 | A1 * | 10/2007 | Geyer et al. | 2/16 |
| 2009/0038052 | A1 * | 2/2009 | Gellis | 2/161.8 |
| 2009/0172864 | A1 * | 7/2009 | Fisher et al. | 2/161.1 |
| 2009/0271913 | A1 * | 11/2009 | Fisher et al. | 2/160 |

FOREIGN PATENT DOCUMENTS

| | | |
|---|---|---|
| CA | 2115026 | 4/1995 |

* cited by examiner

*Primary Examiner* — Danny Worrell
(74) *Attorney, Agent, or Firm* — Freedman & Associates

(57) ABSTRACT

An apparatus for protecting fingers from an injury caused by axial trauma, such as may result during participation in fast pitch softball, includes a finger shield comprising a portion that extends over the end of a wearer's finger. The finger shield is coupled to a palm-plate, which is for being disposed adjacent to the wearer's palm, via a coupling portion. The coupling portion is disposed between the finger shield and the palm-plate for transferring a substantial portion of the force of a significant impact occurring at the end of the wearer's finger to the wearer's palm via the palm-plate.

11 Claims, 9 Drawing Sheets

ANTI-JAM FINGER PROTECTIVE DEVICE

FIELD OF THE INVENTION

The instant invention relates generally to devices for protecting fingers against injury from an impact. More particularly, the instant invention relates to devices for protecting fingers from an injury caused by axial trauma.

BACKGROUND OF THE INVENTION

In many sports, the hands of participating players are highly susceptible to injury during play. A hand injury not only can cause severe pain, discomfort and disruption in the personal life of the player, but also can sideline that player for an entire season, hampering development and performance for that player in the sport. Such injuries impact team performance as well by denying the services of the player to the team. For the amateur player, a hand injury impedes playing time and thus skill development at all ages. In professional sports, hand injuries can have a dramatic effect, such as a negative economic impact on the injured player, as well as on the team of that player. For instance, the team may have to bear the added expense of paying for the services of a replacement player. In addition, if the player is exceptionally skilled in the sport a forced absence due to injury of the player may affect the overall team performance, which in turn could well affect game attendance, playoff chances, fan support, and the financial reward for all.

More specifically, individuals engaging in baseball or fast pitch softball recreational activities frequently are injured when struck by a ball. Such injuries occur most often while batting or while playing the catcher position; in both cases a pitched ball causes the injury. Historically, pitchers have developed pitches intended to fool a batter into thinking the ball will not enter the strike zone, but which actually curve or "move" into the strike zone at the last moment. With the refinement of sophisticated pitching techniques and greater athletic skill, present pitchers are throwing balls faster (80 to 100 miles per hour), and with more movement (such as the so-called curveball, slider, sinker, palmball, knuckle, rise ball, drop ball etc., some moving 12 inches or more), thus requiring both the batter and the catcher to watch the ball very closely after it is released by the pitcher.

Many solutions are currently known for protecting the backs of players' hands and fingers during batting. For instance, in U.S. Pat. No. 5,640,712 Hansen et al. disclose a protective batting glove having a cushioned shield engaged to the glove proximate to the back of the hand of an individual, such that the shield is concealed to provide the appearance of a conventional non-protective batting glove. In U.S. Pat. No. 5,898,938 Baylor et al. disclose gloves including a shock absorbing material in a pad that overlies the area of greatest injury risk on the hands of a batter.

Similarly, a number of solutions are known for protecting the palms of players' hands during catching of a pitched ball. For instance, in Canadian patent 2,115,026 Mah discloses a partial glove including a thin layer of impact absorbing material disposed adjacent a palm portion of the partial glove. The partial glove is worn under a catching glove and provides a measure of protection to the palm and heal portion of the wearer's hand. In U.S. Pat. No. 5,528,772 Cheek discloses a protective device including a padded catching panel and flexible back panel, the device designed to be worn under a catching glove. The catching panel is intended to minimize pain and reduce the instances of injuries caused by a ball being caught at great velocities.

Unfortunately, none of the heretofore-mentioned solutions protects the ends of the fingers from axial trauma, often referred to simply as "jamming injuries." These types of injuries may result when a pitched ball with high velocity curves sharply downward (i.e. drop ball pitch) and strikes the ends of a catcher's fingers. Due to the nature of the catcher's equipment, jamming injuries occur most often in fast pitch softball recreational activities, although similar injuries are seen in players of other sports. Jamming injuries can result in serious damage to the ligaments of the fingers, most often causing stretching or partial tearing of the ligament or its bone attachment point. Ligament sprains must be treated with immobilization followed by physical therapy to regain normal range of motion, while ligament tears require surgery.

It would be advantageous to provide a device that overcomes at least some of the above-mentioned limitations.

SUMMARY OF EMBODIMENTS OF THE INVENTION

In accordance with an aspect of the instant invention there is provided a device comprising: a finger shield comprising a portion that extends over the end of a wearer's finger; a palm-plate for being disposed adjacent to the wearer's palm; and, a coupling portion disposed between the finger shield and the palm-plate for transferring a substantial portion of the force of a significant impact occurring at the end of the wearer's finger to the wearer's palm via the palm-plate.

In accordance with an aspect of the instant invention there is provided a device comprising: a finger shield comprising a quasi-rigid or rigid material, a distal end of the finger shield being curved such that the finger shield extends along at least a portion of the length of the palmar surface of a wearer's finger, over the end of the wearer's finger, and along at least a portion of the length of the dorsal surface of the wearer's finger; and, a palm-plate for being disposed adjacent to the wearer's palm, the palm-plate coupled to the finger shield such that a substantial portion of the force of a significant impact occurring at the end of the wearer's finger is transferred to the wearer's palm via the palm-plate.

In accordance with an aspect of the instant invention there is provided a device comprising: a plurality of finger shields each for receiving a different one of a wearer's fingers, each finger shield comprising a quasi-rigid or rigid material and being sized to extend in an axial direction along at least a portion of the length of the palmar surface of the received finger, over the end of the received finger, and along at least a portion of the length of the dorsal surface of the received finger; a palm-plate for being disposed adjacent to the wearer's palm; and, at least one coupling member for coupling the plurality of finger shields to the palm-plate and for transferring to the wearer's palm via the palm-plate a substantial portion of a force resulting from a significant axial impact to at least one of the plurality of finger shields.

In accordance with an aspect of the invention there is provided a device comprising: a plurality of finger shield portions each for receiving a different one of a wearer's fingers, each finger shield portion comprising a quasi-rigid or rigid material and being sized to extend in an axial direction along substantially the entire length of the palmar surface of the received finger, over the end of the received finger, and along at least a portion of the length of the dorsal surface of the received finger; and, a palm-plate portion for being disposed adjacent to the wearer's palm and for transferring to the wearer's palm a substantial portion of a force resulting from a significant axial impact to at least one of the finger shield portions, wherein the device is a unitary device.

BRIEF DESCRIPTION OF THE DRAWINGS

Exemplary embodiments of the invention will now be described in conjunction with the following drawings, in which.

DETAILED DESCRIPTION OF EMBODIMENTS OF THE INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed, but is to be accorded the widest scope consistent with the principles and features disclosed herein.

Figure 1A:
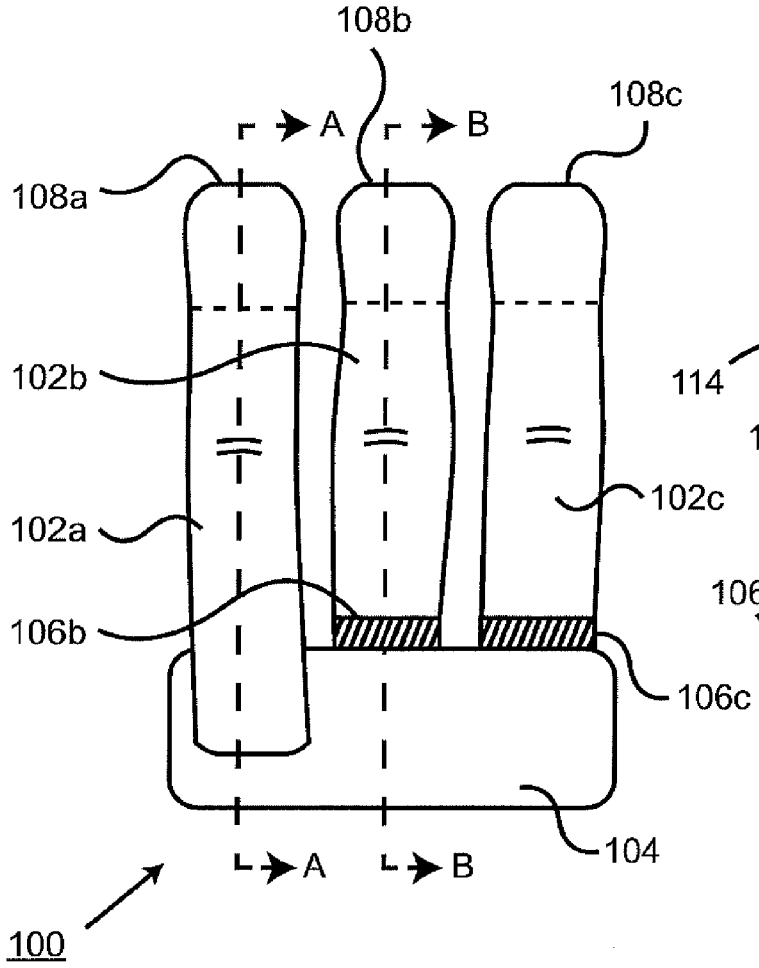
FIG. 1A is a top view of an anti jam finger protective device according to an embodiment of the instant invention.

Referring to FIG. 1A, shown is a top view of an anti jam finger protective device according to an embodiment of the instant invention. The device 100 includes a plurality of finger shields 102*a-c*, a palm-plate 104, and a coupling portion 106*a-c*. Each finger shield 102*a-c* is fabricated from a quasi-rigid material, the quasi-rigid material being somewhat flexible but hard, such as for instance hard plastic, hard rubber or metal. For instance, each finger shield 102*a-c* is fabricated from thermal moldable plastic or rubber based materials, which become generally quasi-rigid when cooled. By way of several specific and non-limiting examples, some contemporary materials that are suitable for this purpose include products that are sold under the names of Orthoplast®, Nickelplast™ or Aquaplast®. Alternatively, the finger shield is fabricated from a rigid material. Optionally, each one of the finger shields 102*a-c* is a monolithic component or is formed from a plurality of layers of material that are laminated together to form a component of desired thickness.

Figure 1B:
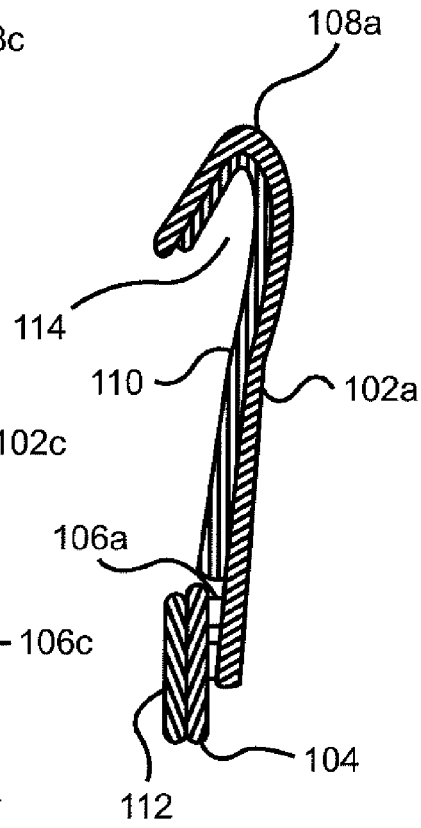
FIG. 1B is a cross section taken along the line A-A in FIG. 1A.

A distal end 108*a-c* of each finger shield 102*a-c*, respectively, is curved, such that the finger shield 102*a-c* extends along at least a portion of the length of the palmar surface of a wearer's finger, over the end of the wearer's finger, and along at least a portion of the length of the dorsal surface of the wearer's finger. Referring also to FIG. 1B, the curved distal end 108*a* of the index finger shield 102*a* is shown in a cross section taken along the line A-A in FIG. 1A. Also shown in FIG. 1B is an optional layer of impact absorbing material 110 provided along a surface of the finger shield 102*a* that faces the index finger of the wearer, and an optional layer of impact absorbing material 112 provided along a surface of the palm-plate 104 that faces the palm of the wearer. For instance, the impact absorbing material is a foam material or a gel material. During use, the end of the wearer's finger is received within a void 114 that is formed by the curved distal end 108*a* of the finger shield 102*a*. A snug fit is not essential to the operation of the device, but the void 114 should be sized sufficiently large so as to avoid pinching or compressing the end of the finger. As is shown in cross-section, the finger shield 102*a* is substantially straight along a portion of the length thereof that opposes the palmar surface of the index finger of the wearer.

Figure 1C:
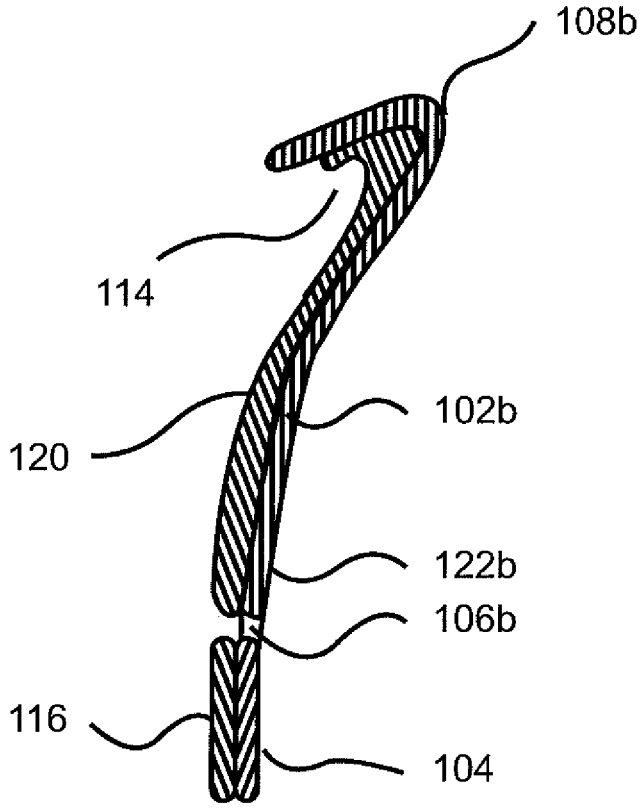
FIG. 1C is a cross section taken along the line B-B in FIG. 1A.

Referring also to FIG. 1C, the curved distal end 108*b* of the middle finger shield 102*b* is shown in a cross section taken along the line B-B in FIG. 1A. Also shown in FIG. 1C is an optional layer of impact absorbing material 120 provided along a surface of the finger shield 102*b* that faces the middle finger of the wearer, and an optional layer of impact absorbing material 116 provided along a surface of the palm-plate 104 that faces the palm of the wearer. For instance, the impact absorbing material is a foam material or a gel material. The layer of impact absorbing material 120 is substantially thicker near the distal end 108*b* of finger shield 102*b* (and of finger shield 102*c*, not illustrated) compared to the layer of impact absorbing material 120 near the proximate end 122*b* of finger shield 102*b*. During use, the end of the wearer's middle finger is received within a void 114 that is formed by the curved distal end 108*b* of the finger shield 102*b*. A snug fit is not essential to the operation of the device, but the void 114 should be sized sufficiently large so as to avoid pinching or compressing the end of the finger. As is shown in cross-section, the finger shield 102*b* (and the finger shield 102*c*, not illustrated) is curved along a portion of the length thereof that opposes the palmar surface of the middle finger of the wearer. This curvature of the finger shield 102*b* (and 102*c*) facilitates wearing the device 100 under a catcher's glove. In addition, the curvature of the finger shield 102*b* (and 102*c*) also helps to direct the force of an impact to the curved distal end 108*b* (and 102*c*) downwards into the palm of a wearer.

Referring still to FIGS. 1A to 1C, the palm plate 104 is also fabricated from a quasi-rigid material or from a rigid material, which is either similar to or identical to the material of the finger shields 102*a-c*. The palm-plate 104 is shaped to rest against the palm of a wearer of the device 100, and is generally aligned with the first knuckle of the wearer's index, middle and ring fingers. In the embodiment that is shown in FIG. 1A, the coupling portion 106*a-c* comprises a plurality of separate coupling portions. Specifically, a first coupling portion 106*a* (shown in dotted lines) is disposed between the palm-plate 104 and a first finger shield 102*a*, a second coupling portion 106*b* is disposed between the palm-plate 104 and a second finger shield 102*b*, and a third coupling portion 106*c* is disposed between the palm-plate 104 and a third finger shield 102*c*. By way of a few specific and non-limiting examples, each coupling portion is fabricated from a resilient material, such as a suitably strong webbing material, or from a rigid or quasi-rigid plastic or rubber spacer material, etc. Furthermore, each coupling portion 106*a-c* supports a pivoting movement between the palm-plate 104 and a respective one of the finger shields 102*a-c*. The pivoting movement allows the wearer to flex his or her fingers at the base knuckle ($1^{st}$ knuckle). That being said, each coupling portion 106*a-c* is sufficiently strong such that a substantial portion of the force of a significant impact at the distal end 108*a-c* of the finger shield 102*a-c* is transferred along the length of the finger shield to the respective coupling portion 106*a-c*, and from the respective coupling portion 106*a-c* to the palm-plate 104 and ultimately to the wearer's palm via the palm-plate 104. In particular, the force of the significant impact is sufficient to cause a jamming injury to the wearer's finger absent the device 100, and is not sufficient to cause a jamming injury to the wearer's finger when the wearer is wearing the device 100.

Figure 2:
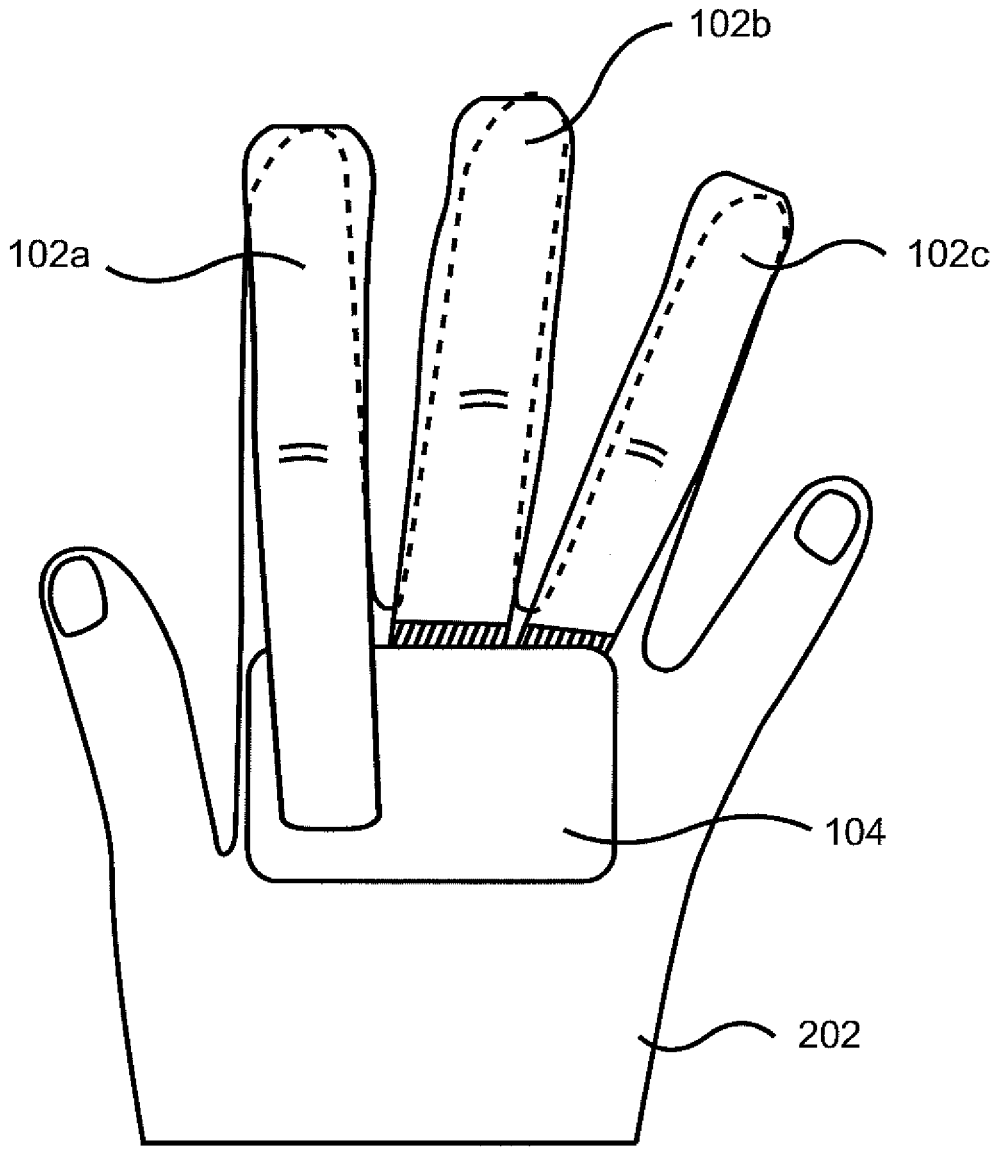
FIG. 2 is a view of a device according to an embodiment of the instant invention being worn by a wearer.

Referring now to FIG. 2, shown is a view of the device 100 being worn by a wearer. In particular, the device 100 is positioned with the palm-plate 104 adjacent to the palm of hand 202 and generally opposite the first knuckle of the wearer's index, middle and ring fingers. First finger shield 102*a* extends along substantially the entire length of the palmar surface of the wearer's index finger, over the end of the index finger, and along a portion of the dorsal surface of the index finger. Second finger shield 102*b* extends along substantially the entire length of the palmar surface of the wearer's middle finger, over the end of the middle finger, and along a portion of the dorsal surface of the middle finger. Third finger shield 102*c* extends along substantially the entire length of the palmar surface of the wearer's ring finger, over the end of the ring finger, and along a portion of the dorsal surface of the ring finger. Accordingly, the tip segment (distal phalanges) of the index finger, middle finger and ring finger are received within the not illustrated void fowled by the curved distal end of the first finger shield 102*a*, the second finger shield 102*b* and the third finger shield 102*c*, respectively.

Figure 3:
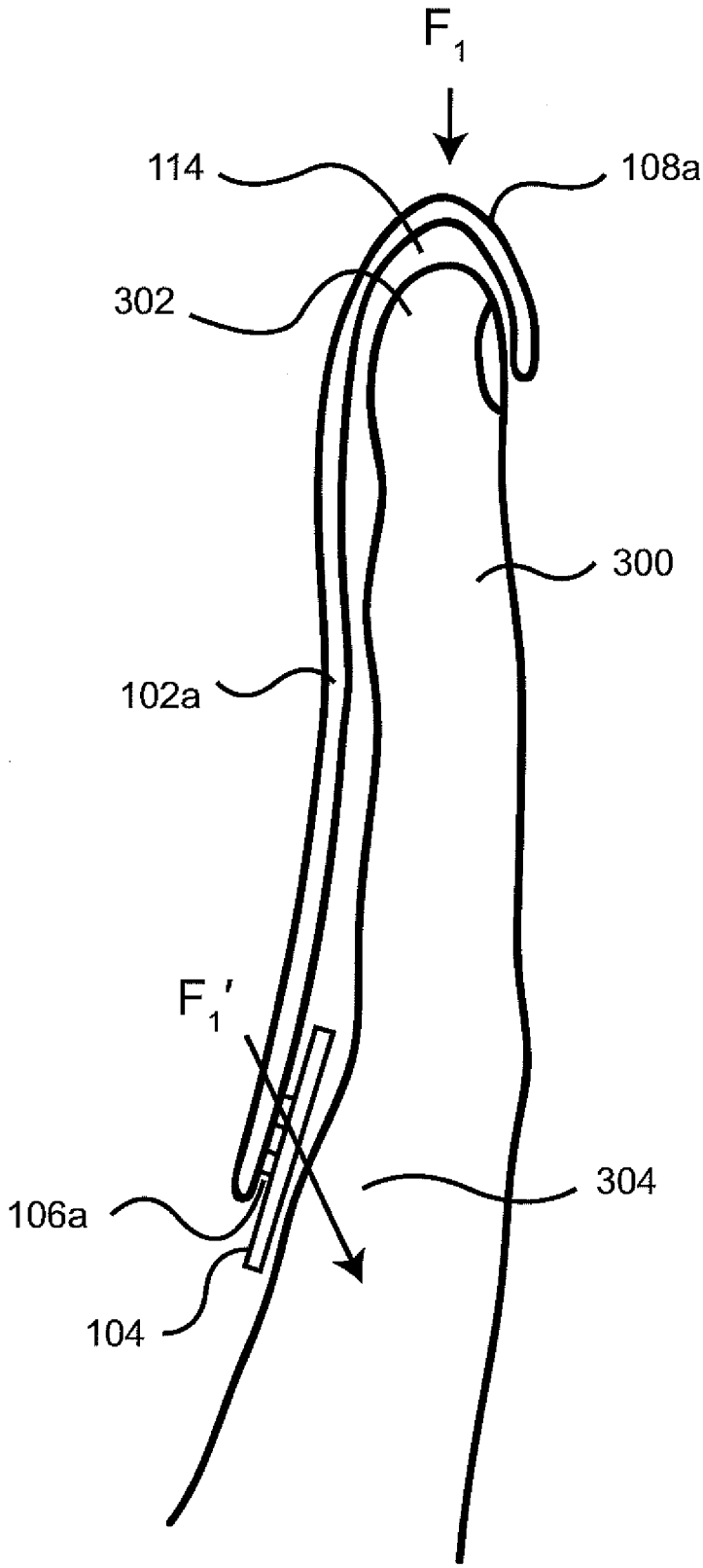
FIG. 3 is a side view of the device being worn on the index finger of a wearer.

Referring now to FIG. 3, shown is a side view of the first finger shield 102*a* and index finger 300 of the wearer. In FIG. 3, the optional layers of impact absorbing material 110 and 112 have been omitted for improved clarity. As is shown more clearly in FIG. 3, the index finger 300 is received by the finger shield 102*a* such that the tip segment (distal phalanges) 302 enters the void 114 that is formed by the curved distal end of the finger shield 102*a*. Also shown in FIG. 3 is a force $F_1$ resulting from a significant axial impact directed along the vector pointing toward the distal end 108*a* of finger shield 102*a*. Since the finger shield 102*a* is formed of a quasi-rigid or rigid material and is coupled to palm-plate 104 by coupling portion 106*a*, a substantial portion $F_1'$ of the force $F_1$ is transferred along the length of the finger shield 102*a*, through the coupling portion 106*a*, to the palm-plate 104 and finally to the user's palm 304. Since a substantial portion of the force is directed away from the end 302 of finger 300, the risk of a jamming injury caused by axial trauma to the finger 300 is reduced greatly.

Figure 4:
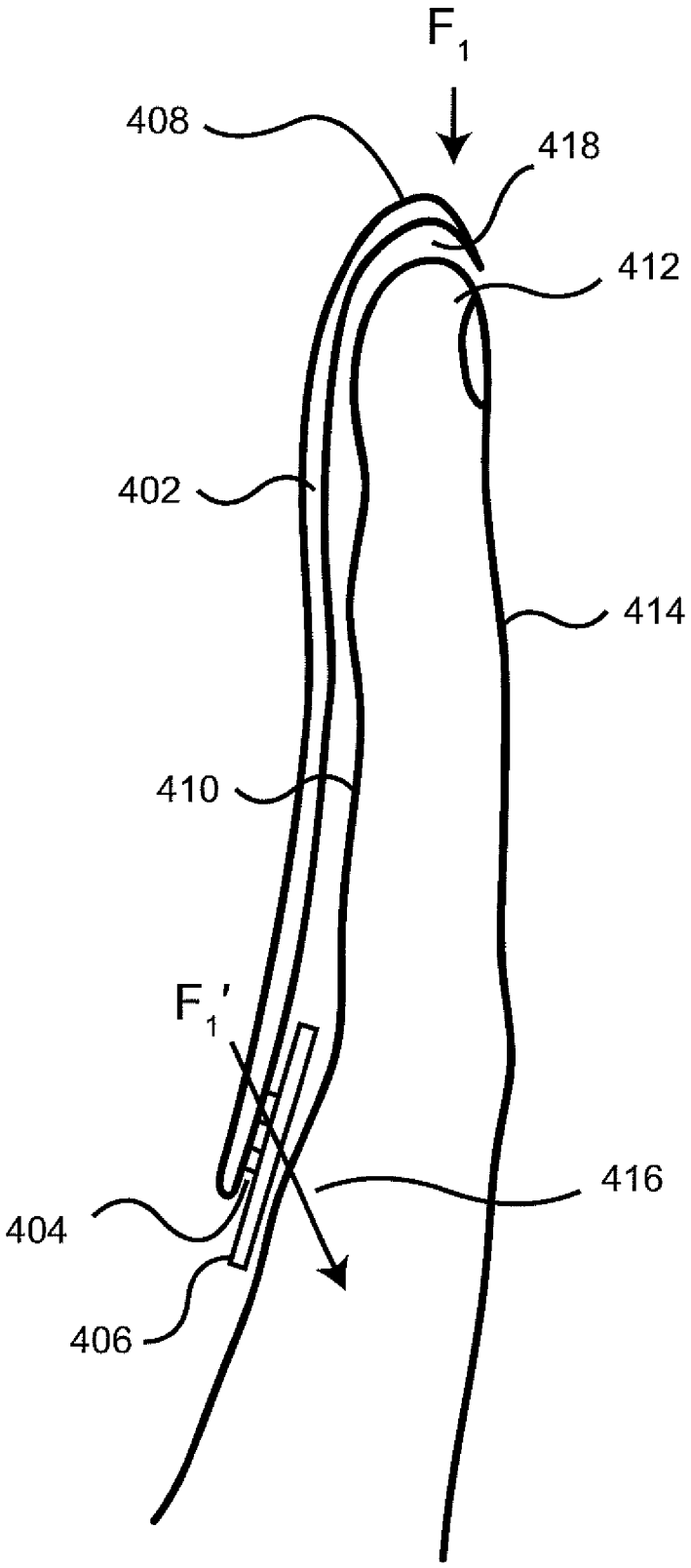
FIG. 4 is a side view of another device according to an embodiment of the instant invention being worn on the index finger of a wearer.

Referring now to FIG. 4, shown is a side view of a finger shield 402 according to an embodiment of the instant invention. The finger shield 402 is coupled via coupling portion 404 to a palm-plate 406. Finger shield 402 is fabricated from a quasi-rigid material, the quasi-rigid material being somewhat flexible but hard, such as for instance hard plastic, hard rubber or a metal. For instance, finger shield 402 is fabricated from thermal moldable plastic or rubber based materials, which become generally quasi-rigid when cooled. By way of several specific and non-limiting examples, some contemporary materials that are suitable for this purpose include products that are sold under the names of Orthoplast®, Nickelplast™ or Aquaplast®. Alternatively, the finger shield is fabricated from a rigid material. Optionally, finger shield 402 is a monolithic component or is formed from a plurality of layers of material that are laminated together to form a component of desired thickness.

A distal end 408 of finger shield 402 is curved, such that the finger shield 402 extends along at least a portion of the length of the palmar surface 410 of a wearer's finger and over the end 412 of the wearer's finger but not along a portion of the length of the dorsal surface 414 of the wearer's finger. Not shown in FIG. 4, an optional layer of impact absorbing material may be provided along a surface of the finger shield 402 that faces the finger of the wearer, and an optional layer of impact absorbing material may be provided along a surface of the palm-plate 406 that faces the palm 416 of the wearer. For instance, the impact absorbing material is a foam material or a gel material. During use, the end 412 of the wearer's finger rests against the wall 418 that is formed by the curved distal end 408 of the finger shield 402. A snug fit is not essential to the operation of the device, but the finger shield 402 should be sized sufficiently large so as to avoid crowding or compressing the end 412 of the wearer's finger against the wall 418.

Referring still to FIG. 4, the palm plate 406 is also fabricated from a quasi-rigid or rigid material, which is either similar to or identical to the material of the finger shield 402. The palm-plate 406 is shaped to rest against the palm 416 of the wearer. The coupling portion 404 is disposed between the palm-plate 406 and the finger shield 402, opposite edges of the coupling portion 404 being affixed to the proximate end 420 of finger shield 402 and to the palm-plate 406. Further, coupling portion 404 supports a pivoting movement between the palm-plate 406 and the finger shield 402. The pivoting movement allows the wearer to flex his or her fingers at the base knuckle ($1^{st}$ knuckle). That being said, the coupling portion 404 is sufficiently strong such that a substantial portion $F_1'$ of a force $F_1$, resulting from a significant axial impact directed along the vector pointing toward the distal end 408 of finger shield 402, is transferred along the length of the finger shield 402 to the coupling portion 404, and from the coupling portion 404 to the palm-plate 406 and ultimately to the wearer's palm 416 via the palm-plate 406. For instance, the coupling portion is fabricated from a rigid or quasi-rigid plastic or rubber spacer material, or from a suitably strong webbing material. Of course, a plurality of finger shields 402 is coupled to the palm-plate 406 via at least a coupling portion 404 in order to form a device similar to device 100 that is shown in FIG. 1A.

Optionally, the lengths of the finger shields 102*a-c* are different so as to accommodate the different lengths of the index finger, the middle finger and the ring finger. Of course, the length of each one of the finger shields 102*a-c* also depends on the amount of impact absorbing material that is provided at the respective distal end 108*a-c*, as well as the amount of void space 114 desired.

Figure 5A:
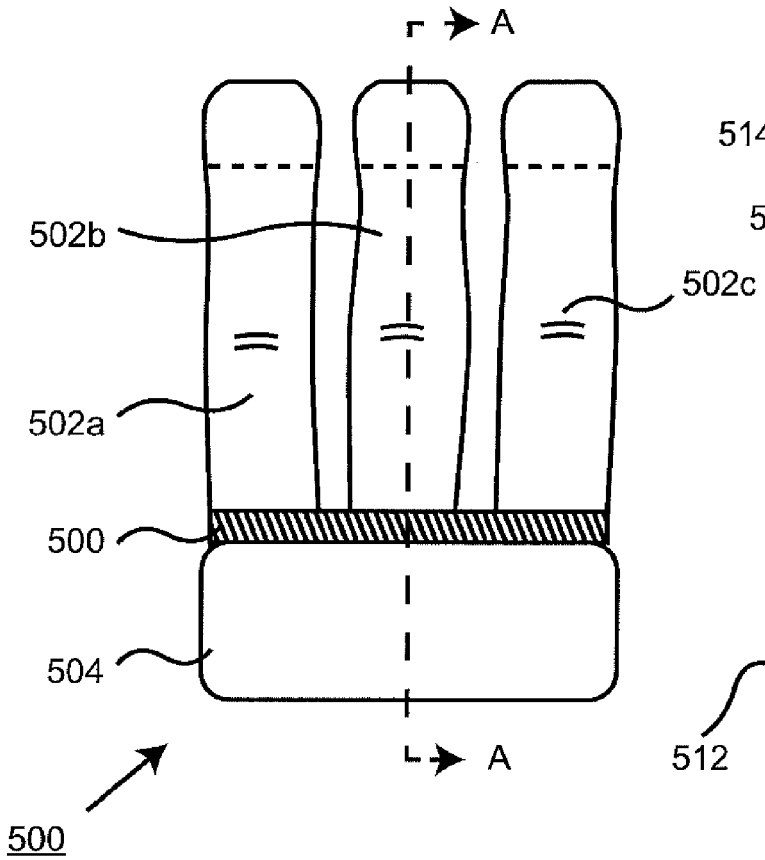
FIG. 5A is a top view of an anti jam finger protective device according to another embodiment of the instant invention.
Figure 5B:
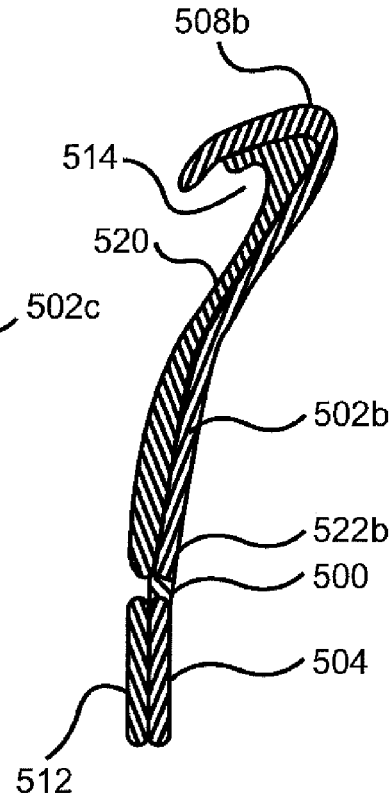
FIG. 5B is cross section taken along the line A-A in FIG. 5A.

Referring now to FIGS. 5A and 5B, shown is an optional modification of the device 100 that was described with reference to FIGS. 1A to 1C. FIG. 5B shows a cross section taken along the line A-A in FIG. 5A. In particular, a plurality of finger shields 502*a-c* is coupled to the palm-plate 504 via a single coupling portion 500, which extends along one edge of the palm-plate 504, and which is secured to proximate ends of each of the finger shields 502*a-c*. Also shown in FIG. 5B is an optional layer of impact absorbing material 520 provided along a surface of the finger shield 502*b* that faces the middle finger of the wearer, and an optional layer of impact absorbing material 512 provided along a surface of the palm-plate 504 that faces the palm of the wearer. For instance, the impact absorbing material is a foam material or a gel material. Optionally, the layer of impact absorbing material 520 is substantially thicker near the distal end 508*b* of finger shield 502*b* (and of finger shield 502*c*, not illustrated) compared to the layer of impact absorbing material 520 near the proximate end 522*b* of finger shield 502*b*. During use, the end of the wearer's middle finger is received within the void 514 that is formed by the curved distal end 508*b* of the finger shield 502*b*. A snug fit is not essential to the operation of the device, but the void 514 should be sized sufficiently large so as to avoid pinching or compressing the end of the finger. As is shown in cross-section, the finger shield 502*b* (and the finger shield 502*c*, not illustrated) is curved along a portion of the length thereof that opposes the palmar surface of the middle finger of the wearer. This curvature of the finger shield 502*b* (and 502*c*) facilitates wearing the device 500 under a catcher's glove. In addition, the curvature of the finger shield 502*b* (and 502*c*) also helps to direct the force of an impact to the curved distal end 508*b* (and 502*c*) downwards into a palm of the wearer.

Optionally, the lengths of the finger shields 502*a-c* are different so as to accommodate the different lengths of the index finger, the middle finger and the ring finger. Of course, the length of each one of the finger shields 502*a-c* also depends on the amount of padding material that is provided at the respective distal ends of the finger shields 502*a-c*, as well as the amount of void space desired.

Figure 6A:
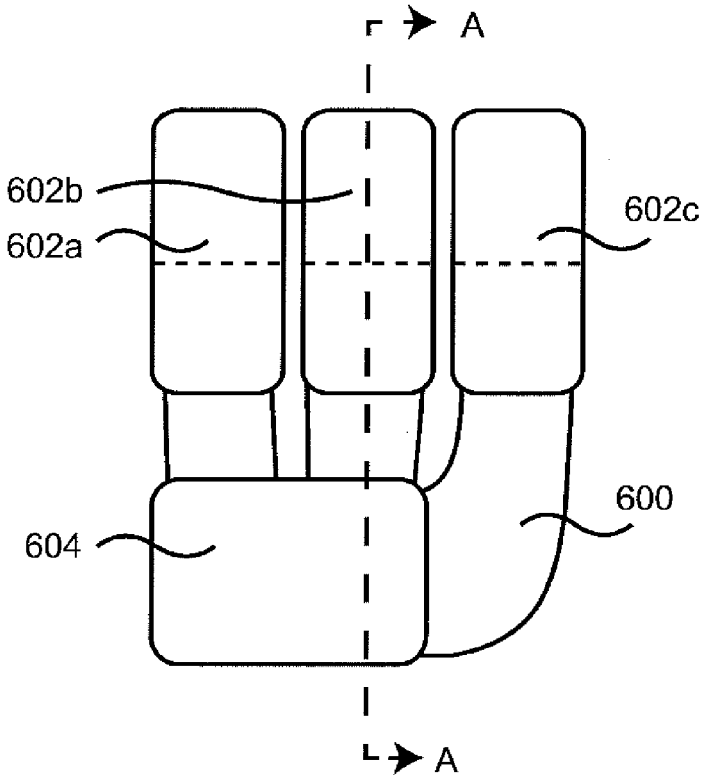
FIG. 6A is a top view of an anti jam finger protective device according to another embodiment of the instant invention.
Figure 6B:
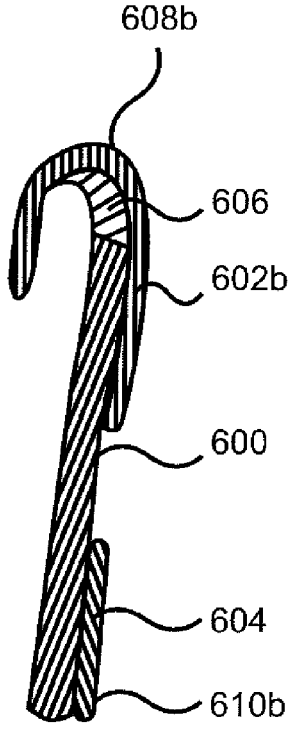
FIG. 6B is cross section taken along the line A-A in FIG. 6A.
Figure 6C:
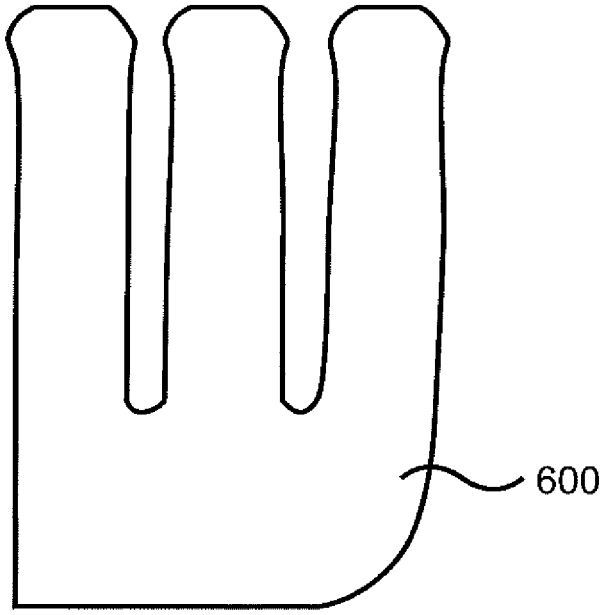
FIG. 6C shows the coupling portion of the anti-jam finger protective device of FIG. 6A.

Referring now to FIGS. 6A, 6B and 6C, shown is another optional modification of the device 100 that was described with reference to FIGS. 1A to 1C. FIG. 6B shows a cross section taken along the line A-A in FIG. 6A, and FIG. 6C shows (in isolation) the coupling portion of the device of FIG. 6A. In particular, a plurality of finger shields 602*a-c* is coupled to a palm-plate 604 via a single coupling portion 600. Each one of the finger shields 602*a-c* extends only approximately to the wearer's $2^{nd}$ knuckle, along the palmar surface of the wearer's fingers. Accordingly, the wearer is able to bend the fingers at both the first and second knuckles. The coupling portion 600, during use, is disposed between the finger shields 602*a-c* and a respective finger of the wearer, and between the palm plate 604 and the palm of the wearer. Each one of the finger shields 602*a-c*, as well as the palm plate 604, is secured to the coupling portion 600, such as by gluing, or by another suitable attachment method.

As shown in FIG. 6B, the coupling portion 600 is continuous between substantially the distal end 608*b* of the finger shield 602*b* and the distal end 610*b* of the palm plate 604. A shock-absorbing insert 606, such as for instance a foam insert, is disposed at the distal end 608*b* of the finger shield 602*b* (and 602*a* and 602*c*, not illustrated) for absorbing the shock of the ball impact to protect the ends of the wearer's fingers. Optionally, the coupling portion 600 extends to the distal end 608*b* of the finger shield 602*b* (and 602*a* and 602*c*, not illustrated) and is shaped to absorb the shock of the ball impact and protect the ends of the wearer's fingers. The coupling portion 600 is disposed adjacent to the palmar surface of the wearer's hand. By way of a specific and non-limiting example, the coupling portion 600 is fabricated from a semi-rigid material with shock-absorbing properties, such as for instance closed cell or syntactic foams. Of course, the density and/or compressive strength of the material of the coupling portion 600 is selected such that, during use, a substantial portion of a force resulting from a significant axial impact directed at the distal end 608*b* of finger shield 602*b* is transferred along the length of the finger shield 602*b*, through the coupling portion 600, to the palm-plate 604 and finally to the wearer's palm.

Figure 7A:
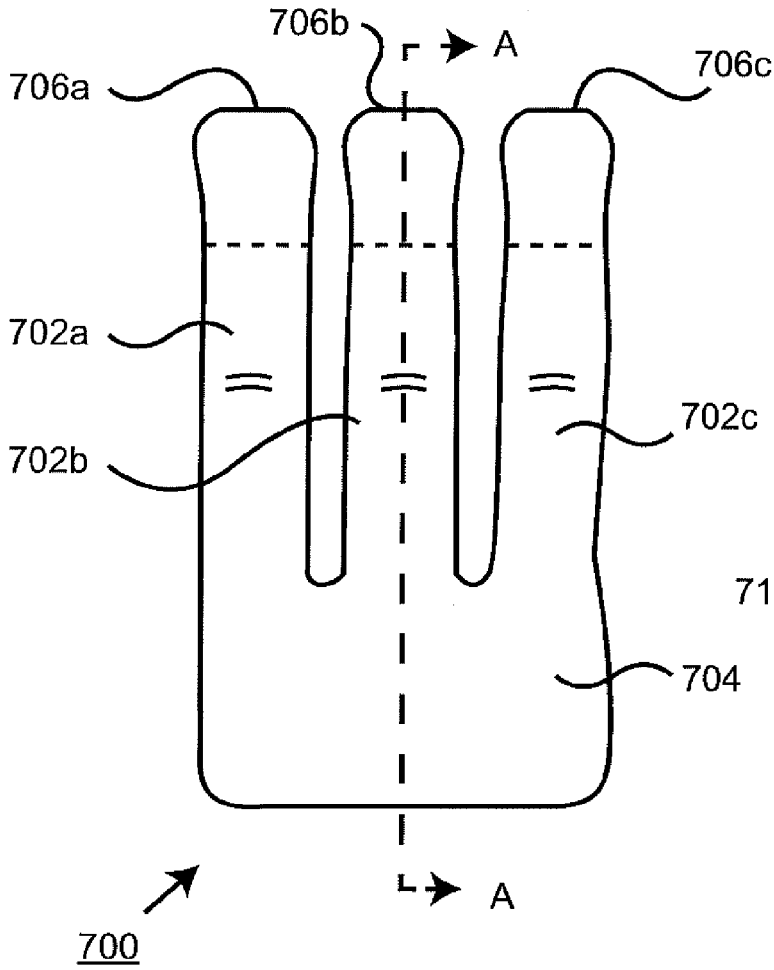
FIG. 7A is a top view of an anti jam finger protective device according to another embodiment of the instant invention; and, FIG. 7B is cross section taken along the line A-A in FIG. 7A.
Figure 7B:
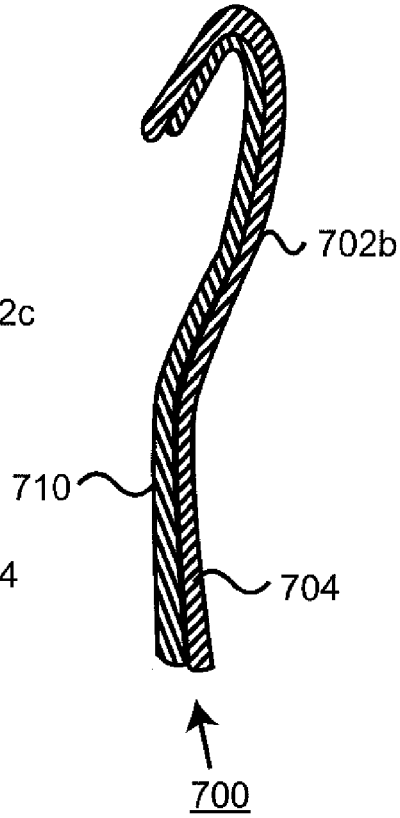

Referring now to FIGS. 7A and 7B, shown is a device 700 according to an embodiment of the instant invention. FIG. 7B shows a cross section taken along the line A-A in FIG. 7A. In particular, a plurality of finger shield portions 702*a-c* extends from a palm-plate portion 704. A distal end 706*a-c* of each of the finger shield portions 702*a-c* is curved, such that the finger shield portions 702*a-c* extend along at least a portion of the length of the palmar surface of a wearer's finger and over the end of the wearer's finger. Optionally, the finger shield portions 702*a-c* also extend along a portion of the length of the dorsal surface of the wearer's finger (similar to finger shields 102*a-c*) or the finger shield portions 702*a-c* do not extend along a portion of the length of the dorsal surface of the wearer's finger (similar to finger shields 402). In the embodiment shown in FIGS. 7A and 7B the coupling portion is omitted, such that the finger shield portions 702*a-c* and the palm-plate portion 704 are integrally formed. For instance, the device 700 is a monolithic component. Optionally, the device 700 is formed from a plurality of separate layers laminated together to form a single component. Also shown in FIG. 7B is an optional layer of impact absorbing material 710 provided along a surface of the finger shield 702*b* that faces the middle finger and palm of the wearer.

Optionally, the devices described above with reference to FIGS. 1A through 7B are adapted to include a thumb shield (not illustrated). For instance, the thumb shield comprises a portion that extends over the end of the wearer's thumb, and the thumb shield is coupled to the palm-plate for transferring to the wearer's palm via the palm-plate at least a portion of the force of an impact that occurs proximate the end of the wearer's thumb. Accordingly, the construction and characteristics of the thumb shield is similar to the finger shields 102*a-c*, the finger shields 402, 602*a-c* or the finger shield portion 702*a-c*.

Optionally, the device 100 or a similar device, in which the finger shields 102*a-c* are replaced by finger shields 402, or the device 600 or 700, is provided separately as a protective device for being worn inside an overlying glove. For instance, a suitable glove comprises a front and back panel with thumb and finger sleeves for receiving a thumb and four fingers of a wearer, and a closure mechanism for retaining the glove on the wearer's hand. The glove should be sized large enough to accommodate the insertion of the device according to an embodiment of the instant invention. Optionally, a device according to an embodiment of the instant invention takes the form of a complete glove with full thumb and finger sleeves, thereby avoiding the use of an additional overlying glove. In either case, a catcher's mitt (or another similar type of mitt) is worn over top of the protective device according to an embodiment of the instant invention.

Optionally, a device according to an embodiment of the instant invention is worn on the dorsal surface of the wearer's hand. For instance, a finger shield extends along substantially the entire length of the dorsal surface of the wearer's finger, over the end of the wearer's finger and along at least a portion of the palmar surface of the wearer's finger. The finger shield is coupled to a palm-plate disposed adjacent the palm of the wearer's hand via a suitable coupling member that extends around the wearer's hand from the dorsal surface to the palmar surface. Optionally, the palm-plate is disposed adjacent a portion of the dorsal surface of the wearer's hand.

Optionally, the lengths of the finger shield portions 702*a-c* are different so as to accommodate the different lengths of the index finger, the middle finger and the ring finger. Of course, the length of each one of the finger shield portions 702*a-c* also depends on the amount of padding material that is provided at the respective distal end 706*a-c*, as well as the amount of void space desired.

Numerous other embodiments may be envisaged without departing from the scope of the invention.

What is claimed is:

1. A system, comprising:

a device comprising:

a finger shield having a substantially uniform width and a substantially uniform material thickness along an entire length thereof, the finger shield comprising a portion that extends along at least a portion of the length of the palmar surface of a wearer's finger from at least about the wearer's second knuckle, over the end of the wearer's finger, and along at least a portion of the length of the dorsal surface of the wearer's finger;

a palm-plate for being disposed adjacent to the wearer's palm;

a coupling portion disposed between the finger shield and the palm-plate for supporting a relative pivoting movement between the finger shield and the palm plate and for transferring at least a portion of a force of an impact occurring at the end of the wearer's finger to the wearer's palm via the palm-plate; and an overlying glove, wherein during use the device is worn inside the overlying glove, and wherein the coupling portion is arranged within a space that is formed between a surface of the finger shield and a surface of the palm plate and that is approximately aligned with the wearer's first knuckle when the device is being worn inside the overlying glove.

2. A system according to claim 1, wherein the finger shield is a monolithic component.

3. A system according to claim 1, wherein the finger shield comprises a plurality of layers of material that are laminated together to form a single component.

4. A system according to claim 1, comprising at least one additional finger shield having a substantially uniform width and a substantially uniform material thickness along an entire length thereof, the at least one additional finger shield comprising a portion that extends over the end of another one of the wearer's fingers, the at least one additional finger shield coupled to the palm-plate for transferring at least a portion of a force of an impact that occurs proximate the end of the other one of the wearer's fingers to the wearer's palm via the palm-plate.

5. A system, comprising:

a device comprising:

a finger shield having a substantially uniform width and a substantially uniform material thickness along an entire length thereof, a distal end of the finger shield being curved such that the finger shield extends along at least a portion of the length of the palmar surface of a wearer's finger from at least about the wearer's second knuckle, over the end of the wearer's finger, and along at least a portion of the length of the dorsal surface of the wearer's finger;

a palm-plate for being disposed adjacent to the wearer's palm;

a coupling portion disposed between the finger shield and the palm-plate for supporting a relative pivoting movement between the finger shield and the palm plate and for transferring at least a portion of a force of an impact occurring at the end of the wearer's finger to the wearer's palm via the palm-plate, and an overlying glove, wherein during use the device is worn inside the overlying glove, and wherein the coupling portion is arranged within a space that is formed between a surface of the finger shield and a surface of the palm plate and that is approximately aligned with the wearer's first knuckle when the device is being worn inside the overlying glove.

6. A system according to claim 5, comprising a layer of an impact-absorbing material for being disposed between the finger shield and at least a portion of the wearer's finger.

7. A system according to claim 5, wherein the finger shield is a monolithic component.

8. A system according to claim 5, wherein the finger shield comprises a plurality of layers of material that are laminated together to form a single component.

9. A system according to claim 5, wherein the finger shield comprises a connector disposed between a first portion of the finger shield and a second portion of the finger shield, the connector for supporting a pivoting movement between the first portion of the finger shield and the second portion of the finger shield.

10. A system according to claim 5, wherein the finger shield is a first finger shield for extending over the end of an index finger of the wearer, the device further comprising a second finger shield for extending over the end of a middle finger of the wearer and a third finger shield for extending over the end of a ring finger of the wearer, each of the second and third finger shields having a substantially uniform width and a substantially uniform material thickness along an entire length thereof, the first finger shield coupled to the palm-plate for transferring the at least a portion of the force of the impact that occurs proximate the end of the index finger to the wearer's palm via the palm-plate, the second finger shield coupled to the palm-plate for transferring at least a portion of a force of an impact that occurs proximate the end of the middle finger to the wearer's palm via the palm-plate, and the third finger shield coupled to the palm-plate for transferring at least a portion of a force of an impact that occurs proximate the end of the ring finger to the wearer's palm via the palm-plate.

11. A system according to claim 5, comprising a thumb shield, a distal end of the thumb shield being curved such that the thumb shield extends along at least a portion of the length of the palmar surface of the wearer's thumb, over the end of the wearer's thumb, and along at least a portion of the length of the dorsal surface of the wearer's thumb, the thumb shield coupled to the palm-plate for transferring at least a portion of a force of an impact that occurs proximate the end of the wearer's thumb to the wearer's palm via the palm-plate.

* * * * *